United States Patent [19]

Katagiri et al.

[11] 4,379,684

[45] Apr. 12, 1983

[54] PRESS FOR POWDER METALLURGY

[75] Inventors: Takeshi Katagiri, Machida; Takakazu Tsuchifuji, Tokyo, both of Japan

[73] Assignee: Yoshizuka Seiki Co., Ltd., Kawasaki, Japan

[21] Appl. No.: 272,679

[22] Filed: Jun. 11, 1981

[30] Foreign Application Priority Data

Jun. 13, 1980 [JP] Japan ..... 55-79853

[51] Int. Cl.[3] ..... B30B 11/02

[52] U.S. Cl. ..... 425/78; 425/415; 425/416; 425/444

[58] Field of Search ..... 264/111; 425/78, 415, 425/416, 444

[56] References Cited

U.S. PATENT DOCUMENTS

| | | | |
|---|---|---|---|
| 1,648,721 | 11/1927 | Claus | 264/111 |
| 2,562,876 | 8/1951 | Baeza | 425/78 |
| 2,570,989 | 10/1951 | Sielig | 425/78 |
| 2,883,703 | 4/1959 | Frank | 425/78 |
| 2,888,715 | 6/1959 | Frank | 264/111 |
| 2,932,063 | 4/1960 | Belden et al. | 425/78 |
| 3,098,261 | 7/1963 | Littley et al. | 264/111 |
| 3,200,465 | 8/1965 | Lossman | 425/415 |
| 3,559,243 | 2/1971 | Hermet | 425/78 |
| 3,758,245 | 9/1973 | Hermet | 425/78 |
| 3,802,818 | 4/1974 | Watanabe et al. | 425/415 |
| 3,868,201 | 2/1975 | Jacobson et al. | 264/111 |
| 3,890,413 | 6/1975 | Peterson | 264/111 |

FOREIGN PATENT DOCUMENTS

| | | |
|---|---|---|
| 2033891 | 2/1972 | Fed. Rep. of Germany . |
| 544652 | 1/1974 | Switzerland . |

OTHER PUBLICATIONS

"Powder Metallurgy Technics Course No. 4", Metal Powder Forming, New Japan Printing Inc., Tokyo, Aug. 64.

*Primary Examiner*—James B. Lowe

*Attorney, Agent, or Firm*—Fleit, Jacobson & Cohn

[57] ABSTRACT

Press for powder metallurgy and method of simultaneous compression of powder in a die disclosed which includes descent speed differentially control apparatuses for simultaneous compression powder in the die from both the upper and lower direction by an upper punch and a lower punch. The descent speed of an upper ram is transferred to the upper punch at that speed, and the speed is changed to lower speed through the control device than the upper punch speed and the controlled lower speed is transferred to a die holder which is simultaneously descended with the controlled lower speed together with the high speed upper punch.

3 Claims, 10 Drawing Figures

PRESS FOR POWDER METALLURGY

BACKGROUND OF THE INVENTION

This invention relates to an improvement of a press for powder metallurgy and more particularly to a press or apparatus having simultaneous compression in both directions and comprising die holder which moves with a die at different lower speed than the speed of an upper punch. The upper punch holder and poke rods are simultaneously driven by an upper ram to press and compress simultaneously powder filled in the die from both the upper and lower directions of the die.

In the field of powder metallurgy, it is realized that the powder for metallurgy must be compressed to provide uniform density and subsequently to provide very accurate dimensions for a formed art product. However, in a conventional press, the powder in the die is compressed in different steps respectively by an upper punch and a lower punch, and is further recompressed by the upper punch after compression by the lower punch. Therefore, the uniform density and accurate dimensions of the formed art are not expected.

In the conventional press shown in FIG. 1A, FIG. 1B and FIG. 1C, firstly the powder is filled in a die hole and an upper punch 11 is inserted within the die hole in accordance with driving of an upper ram which is settled at upper portion of press apparatus, then the upper punch starts exerting pressure upon the powder P' as shown in FIG. 1A. In this step, the powder of upper portion in the die hole is compressed as shown by a downward arrow head in FIG. 1A. Secondly, when the upper punch 11 descends further one step, a die 71 which is held by a die holder or die plate descends accordingly with same stroke of the moving distance of the upper punch as shown by a downward arrow head in FIG. 1B, where the powder P' of lower portion in the die hole is simultaneously and upwardly compressed by a fixed lower punch 81 relative to descent of the die 71 and upper punch 11 as shown by an upward arrow head in FIG. 1B, since the lower punch 81 which is positioned in the die 71 is fixed to a fixed lower base. Further, when the die 71 stops descending and is fixed, the upper punch 11 still presses and inserts in the die hole and compresses again the powder downwardly as shown by a downward arrow head in FIG. 1C, then compression of the powder P' is completed.

In FIG. 2 which shows continuous curve lines of one process of the conventional press operation shown in FIG. 1A, FIG. 1B and FIG. 1C, the curve line A shows movement of the upper punch and the other curve line B shows movement of the die. At point a, the upper punch starts pressing the powder and descends in that condition, and from a point b, the die starts descending with the upper punch, and during this movement the lower punch compresses substantially powder upwardly, and then from a portion that the curve line B changes to horizontal line at about 160 or 165 degrees, only the upper punch descends further until 180 degrees, and at a point c the substantial compresion operation is completed. From 180 degrees to 360 degrees of the curve line A, the upper punch ascends for preparation of a next operation, and from 210 degrees to 270 degrees of the other curve line B, the die further descends, and during the lowest portion from 270 degrees to 300 degrees, the formed art product is taken out, and thereafter the die ascends again for preparation of the next operation.

As stated above, in the conventional powder metallurgy press, the powder in the die hole is alternately compressed one by one per one step from respective other directions through three steps, that is, the powder is firstly downwardly compressed, and is secondly upwardly compressed, and is lastly again downwardly compressed, and is subsequently completed. Therefore, the uniform density of the product is not obtained because of reciprocating movement of the powder in the die hole on all such occasions of change of the pressure directions therein, and the accurate dimensions of the product are not expected in consequence of such uneven density and occurrence of defacement of the die, a core or other equipments of the press.

SUMMARY OF THE INVENTION

The present invention provides a new and more efficient press and a method to obtain a formed art which has uniform density and very accurate dimensions by movement of an upper punch and a movable die. In case where powder for metallurgy is prepared within the die and a fixed lower punch is set therein, and the upper punch moves downwardly and presses firstly powder from the upper direction in the die and poke rods of an upper punch holder settled the upper punch push downwardly a die holder through pivotal levers and receiving pieces, and the die which is fixed to the die holder is downwardly pushed accordingly, the die moves downwardly at different lower speed than the upper punch. In accordance with movement of the upper punch, the powder is pressed from the upper direction by the upper punch and at the same time the powder is simultaneously and substantially pressed from the lower direction by the lower punch in accordance with special operation of the different speed movement of the die. By this operation of simultaneous compression from both the directions in the die, the powder has uniform density and is formed with very accurate dimensions.

Accordingly, an object of the present invention is to provide a press which presses powder in a die and compresses simultaneously from both the upper and lower directions to obtain a formed art which has uniform density and has very accurate dimensions.

Another object of the present invention is to provide a press which moves an upper punch and the die at different speeds to compress the powder in the die by the upper punch and a lower punch from both directions.

Another object of the present invention is to provide a method of simultaneous compression of the powder in the die by operation of the upper punch and the die with respectively different speeds.

Other objects and many of the attendant advantages of this invention will be readily appreciated as the same becomes better understood by reference to the following description.

BRIEF DESCRIPTION OF THE DRAWINGS

The accompanying drawings illustrate the preferred embodiment of the present invention. In the drawings, the same reference numerals illustrate the same parts of the invention, in which.

THE DETAILED DESCRIPTION OF THE INVENTION

Figure 3:
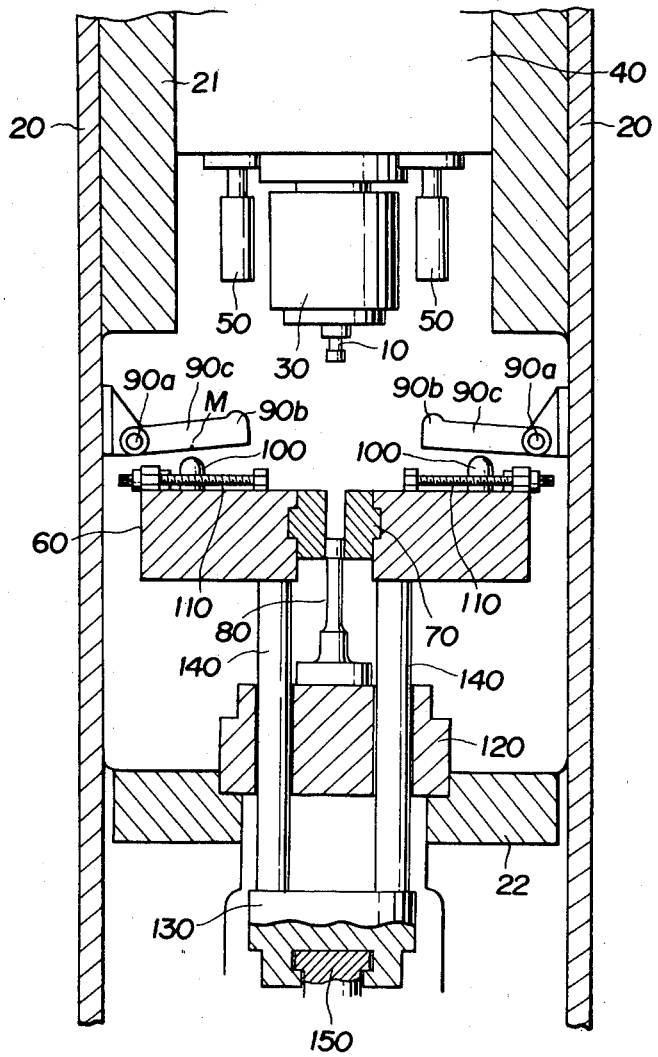
FIG. 3 is a partial vertical cross-sectional view of a press comprising the present invention and showing an empty condition of the press prior to operation.

Referring to the drawings, there is shown according to a preferred embodiment of the invention, as shown in FIG. 3, a press for powder metallurgy that has an upper punch 10 which is supported by a punch holder 30, and is positioned at an upper center portion of a housing or frame 20. This holder 30 is supported by an upper arm ram 40, and this ram 40 has at least one pair of poke rods 50, 50 which are vertically fixed under the ram 40 and are positioned on opposite sides and spaced from the holder 30, then each lower end of the rods 50, 50 is positioned higher than the upper punch 10. The frame 20 has a lug and the upper ram 40 is installed between the lug 21. The upper ram 40 is connected to a driving apparatus having a crank means which are not shown in the drawings. A die holder or die plate 60 is settled at each upper end of lower rods 140, 140, and is positioned at the center in the frame 20, and a die 70 is set at the center of the die holder 60 under the upper punch 10, and the die 70 has a die hole which is provided underneath the upper punch and receives the powder the upper punch therein. In the die hole, an upper portion of a lower punch 80 is concentrically inserted. The lower punch 80 is settled on a fixed plate 120 which is settled on a lower base 22. At least a pair of pivotal levers 90, 90 are pivoted at each pivot axis **90*a* on each flange underneath the poke rods 50, 50, which flanges are transversely and inwardly extended from the frame 20**.

In accordance with movement by the poke rods 50, 50 which descend with the upper punch 10, each lower end of the rods 50, 50 contacts on each head **90*b* of the pivotal lever 90, then the levers 90, 90 are pivotally and downwardly moved. At least a pair of receiving pieces 100, 100 which the number corresponds to the number of the pivotal levers are controllably provided on the die holder 60 and underneath each body 90*c* of the pivotal levers 90, 90. Also, at least a pair of the screw threaded rods 110, 110 are transversely provided through the receiving pieces 100, 100 on the die holder 60. The pair of the screw threaded receiving pieces 100, 100 controllably move the same distance with same pitch on the screw threaded rods 110, 110 which are rotated when the receiving pieces 100, 100** are adjusted.

Each of the poke rod 50, pivotal lever 90 and receiving piece 100 of the pairs thereof is respectively positioned on the same vertical axis line, and the poke rods 50, 50 and the pivotal levers 90, 90 move vertically on the same vertical axis line. Then, the receiving pieces 100 are contacted and pushed downwardly at a preferable optional point between both the ends of the pivotal lever, for instance at the intermediate point M of the lever 90. The die holder 60 is pushed and is downwardly moved in accordance with force of push by the pivotal levers 90, 90.

The distance of vertical movement or descent of the die holder 60 is in proportion to the distance between the pivotal axis **90*a* and a point of contact with the receiving piece 100**.

The fixed plate 120 is fixedly provided on the lower base as a press table, and the pressure force imposed on the lower punch 80 is caught on the fixed plate 120, when the press is operating. A yoke plate 130 is connected to the die holder 60 through the rods 140, 140 which are provided at least one pair, and the yoke plate 130 is connected to a lower ram 150. As shown in FIG. 3, at least one pair of the rods 140 connects the die holder 60 and the yoke plate 130 through the fixed plate.

Figure 4:
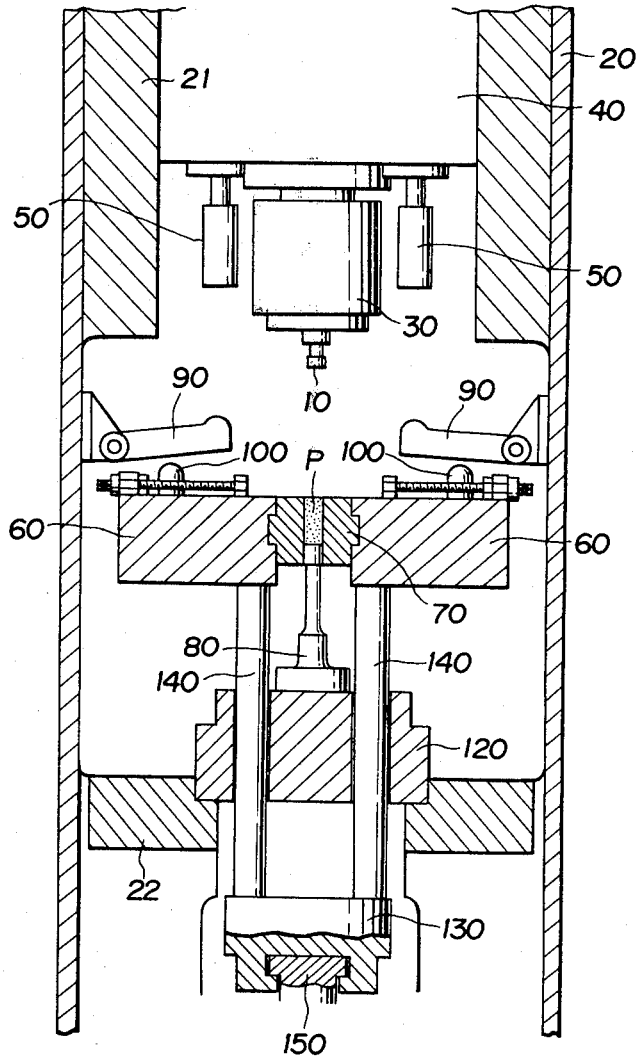
FIG. 4 is a partial vertical cross-sectional view of the press of the present invention showing a next condition filled up the powder in a die.
Figure 5:
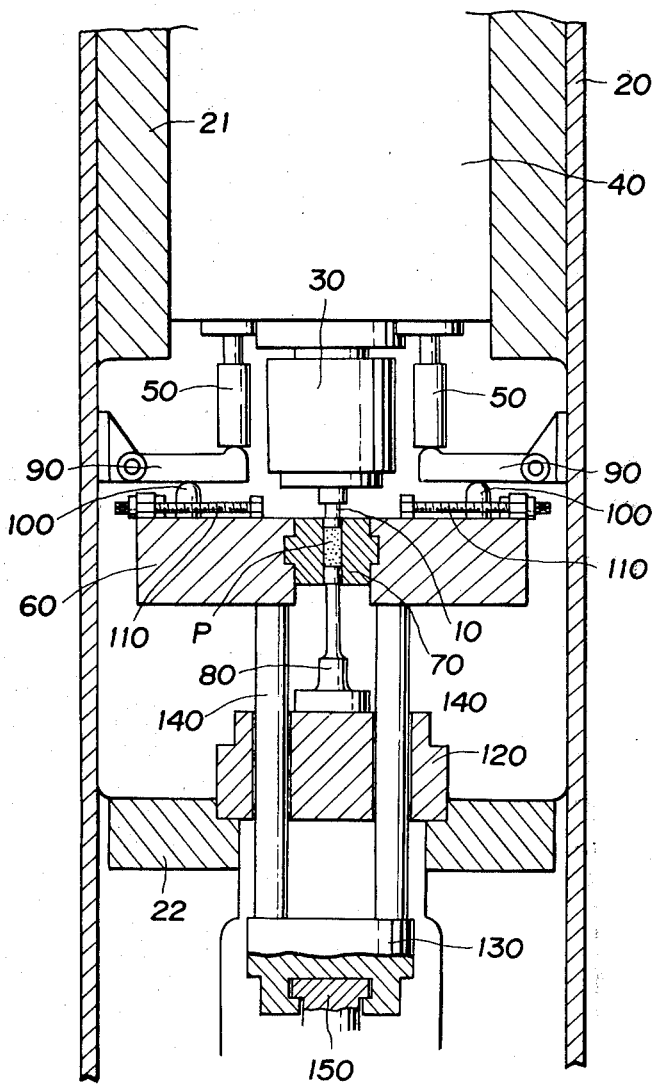
FIG. 5 is a vertical partial cross-sectional view of the press of the present invention showing compression starting condition by an upper punch.

With respect to operation in accordance with the present invention, required volume powder P for metallurgy is filled in the die hole of the die 70 as shown in FIG. 4, then the upper ram 40 descends and the upper punch inserts in the die hole and starts pressing the powder P in a predetermined manner as shown in FIG. 5. In FIG. 5, it is shown that each of poke rod 50, pivotal lever 90 and receiving piece 100 is respectively contacted to push downwardly the die holder 60.

Figure 6:
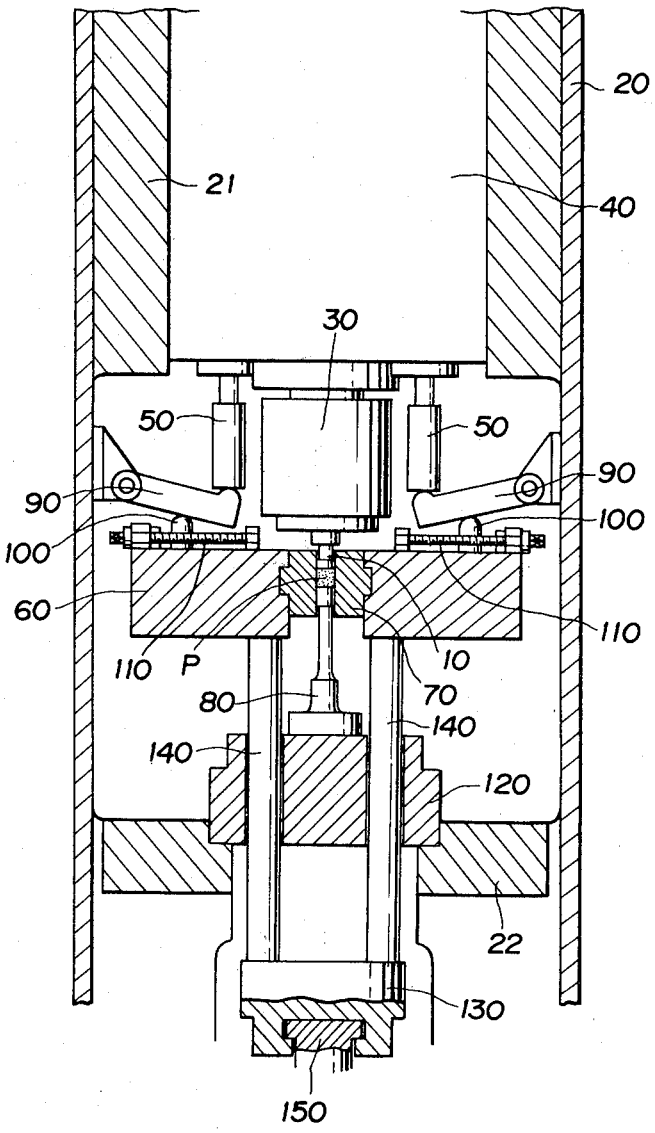
FIG. 6 is a vertical partial cross-sectional view of the press of the present invention showing compression finished condition by the upper punch and a lower punch.

Further, when the upper punch 10 further descends, the poke rods 50, 50 push downwardly each head **90*b*, 90*b* of both levers 90, 90, then the die holder 60 relatively descends through the receiving pieces 100, 100 which are positioned underneath each body 90*c* of the pivotal lever 90. When the relative position between the die holder 70 and the fixed lower punch 80 is settled, final compression of the powder P by the upper punch 10 is exerted as shown in FIG. 6. In this case where the upper punch 10 and the die holder 60 descend, the speed of moving of the die holder 60 is lower than the speed of the upper punch 10**.

Figures 1A, 1B, 1C:
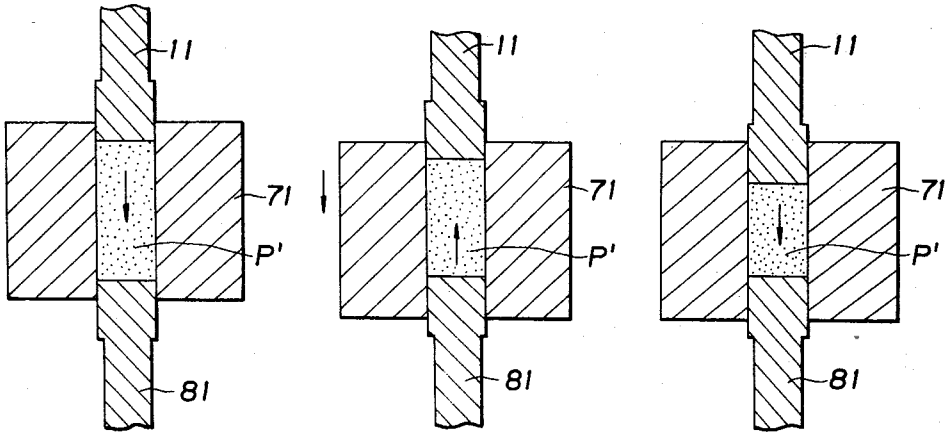
FIG. 1A is a diagrammatic theoretical explanation view of a conventional press showing a first condition of pressing powder by an upper punch.
FIG. 1B is a diagrammatic theoretical explanation view of the conventional press showing a next condition of pressing the powder by a lower punch in accordance with descending a die and the upper punch.
FIG. 1C is a diagrammatic theoretical explanation view of the conventional press showing a last condition of pressing the powder by further descent of the upper punch.
Figure 2:
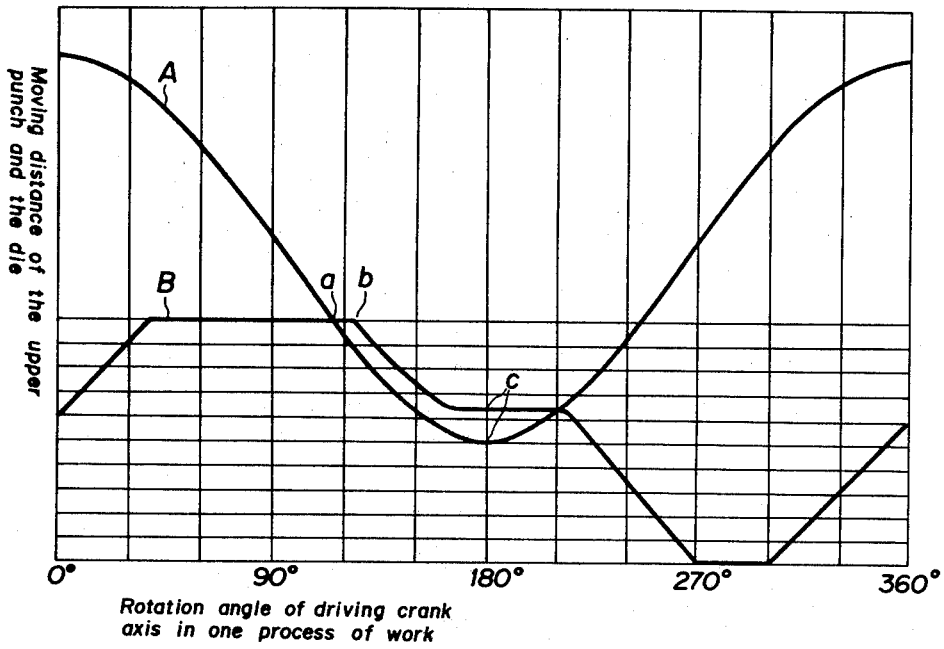
FIG. 2 is a graph showing continuous curve lines of one process of the conventional press apparatus.
Figure 8:
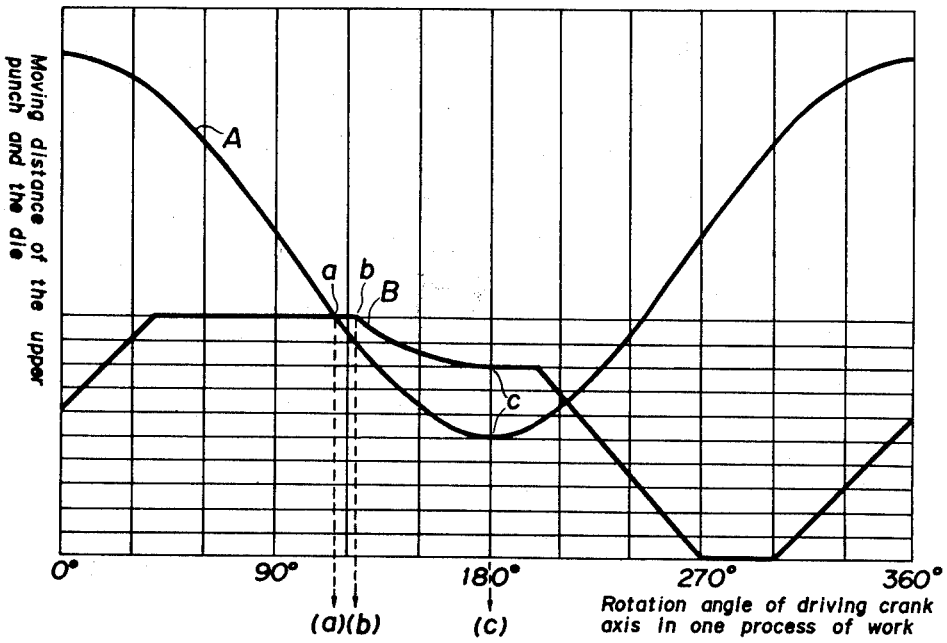
FIG. 8 is a graph showing continuous curve lines of one process of the press of the present invention.

The compression steps shown in FIG. 5 and FIG. 6 are explained in detail with reference to FIG. 8. In FIG. 8, a curve line A is an operational curve line A of the upper punch, and the other curve line B is an operational curve line B of the die holder. At point a on the line A, the upper punch inserted in the die hole of the die 70 starts pressing the powder P. And when the upper punch 10 further descends, the poke rods 50, 50 push downwardly the pivotal levers 90, 90 and further, the receiving pieces 100, 100 are downwardly pushed, accordingly, the die holder or plate 60 starts relatively descending from point b on the line B. Until completion of compression of the powder P, that is, from the point b of the lines A and B to point c of both lines A and B, the upper punch 10 and the die holder 70 relatively descend.

In this embodiment of the present invention, the fulcrum of the receiving piece 100 is provided at mark M, that is, at half point between the pivotal axis 90*a* and the head 90*b* thereof, the die holder 60 which removably fixed the die descends relatively at half speed than the descent speed of the upper punch. The differential downward movements of the upper punch and the die are shown by both curve lines between point b and point c in FIG. 8. Accordingly, the filled powder P in the die 70 is compressed by the downward pressure force by the upper punch 10 and is simultaneously compressed by the upward pressure force by the lower punch 80, that is, the powder P is simultaneously compressed from both directions by the upper punch and the lower punch. However, actually, the proportional rate of both the speed of the upper ram or upper punch and the die may become different from the predetermined rate, 2:1, in accordance with occurrence of friction between the die and the powder and or rubbing between the die and the other equipments.

Figure 7:
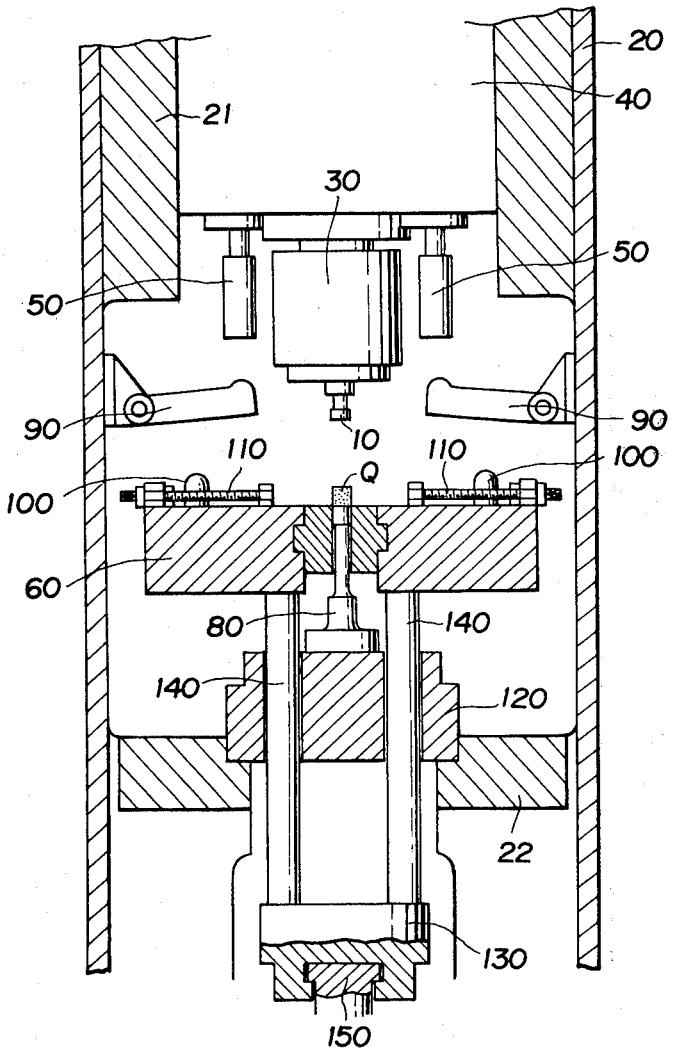
FIG. 7 is a vertical partial cross-sectional view of the press of the present invention showing an extruded condition of the formed art.

When the compression of the powder is completed, the upper ram 40 ascends, and the lower ram 150 descends further one step. The die holder 60 descends accordingly with the descent of the lower ram 150 to the position to freely take out the formed art product, then a knockout step is completed as shown in FIG. 7.

As described above, the present invention has many advantages to provide the very accurate dimension product and to provide the uniform density product by simultaneous compression from both the directions in the die by reduction of friction and rubbing between the powder, die and other equipments, in accordance with the many features that the powder filled in the die hole of the die is able to be simultaneously compressed from the upper and lower directions without any reciprocating movement of the powder to any direction through compression steps, since the descent distance and speed of the die become relatively shorter and lower than the descent distance and speed of the upper punch in the compression step.

The invention may be embodied in other specific form without departing from its spirit or essential characteristics. The described embodiment is to be considered in all respect only as illustrative and not limiting and the scope of the invention is, therefore, indicated by the appendant claims rather than by the foregoing description. All changes which come within the meansing and range of equivalency of the claims are to be amended within their scope. Consequently, it is recognized many variations may be made without departing from the scope or spirit of the present invention.

What is claimed is:

1. A press for powder metallurgy comprising:

a frame;

a die holder mounted on said frame for movement with respect to said frame;

an open-ended die mounted in said die holder;

a lower punch fixed with respect to said frame and forming the bottom of said die;

an upper punch movable with respect to said frame and insertable into said die to form the top thereof;

an upper ram for vertically moving said upper punch into said die at a first rate of speed;

poke rods vertically movable by said upper ram;

levers pivotally connected to and extending inwardly from said frame and having head portions positioned vertically below said poke rods so that said head portions are contacted and pivoted downwardly by said poke rods;

screw threaded rods carried by said die holder and spaced above the upper surfaces thereof; and receiving pieces translatable along said threaded rods by rotation of said rods, said receiving pieces being positioned vertically below said levers so that said receiving pieces are contacted by said levers when said levers are pivoted downwardly by said poke rods whereby said die is moved downwardly at a rate of speed determined by the positions of said receiving pieces on said rods to thereby subject material in the die to compressive forces simultaneously acting on both the top and bottom surfaces of material in the die.

2. A press according to claim 1, further comprising means for moving said die holder downwardly, said ram means being operative after movement of said upper punch out of said die so that said lower punch forces a formed article out of said die.

3. A press according to claim 1 or claim 2, wherein lower surfaces of said poke rods are positioned vertically above the lower end of said upper punch.

* * * * *